US008665059B2

(12) United States Patent
Korony et al.

(10) Patent No.: US 8,665,059 B2
(45) Date of Patent: Mar. 4, 2014

(54) HIGH FREQUENCY RESISTOR

(71) Applicant: AVX Corporation, Fountain Inn, SC (US)

(72) Inventors: Gheorghe Korony, Myrtle Beach, SC (US); Kevin D. Christian, Myrtle Beach, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 13/644,355

(22) Filed: Oct. 4, 2012

(65) Prior Publication Data

US 2013/0127588 A1 May 23, 2013

Related U.S. Application Data

(60) Provisional application No. 61/561,334, filed on Nov. 18, 2011.

(51) Int. Cl.
*H01C 1/012* (2006.01)

(52) U.S. Cl.
USPC ..... 338/314; 330/283; 324/641

(58) Field of Classification Search
USPC ..... 338/314
See application file for complete search history.

(56) References Cited

U.S. PATENT DOCUMENTS 3,629,701 A * 12/1971 Ichijo ..... 324/659
4,058,445 A 11/1977 Anders
6,097,276 A * 8/2000 Van Den Broek et al. ..... 338/9
6,819,569 B1 11/2004 Broman et al.
6,927,633 B2 * 8/2005 Banba et al. ..... 330/283
7,042,232 B1 5/2006 Jacobs
7,200,010 B2 4/2007 Broman et al.
7,830,241 B2 11/2010 Lai et al.
8,098,127 B2 * 1/2012 Tchaplia ..... 338/320
2008/0093113 A1 * 4/2008 Jow et al. ..... 174/260

OTHER PUBLICATIONS

"High Frequency Chip Resistor Terminators", TT electronics, Welwyn Components Limited, PFC HF Series Issue Jun. 2006 (Bedington, Northumberland, UK).

"High Frequency (up to 20 GHz) Resistor, Thin Film Surface Mount Chip", Vishay Thin Film, Vishay Intertechnology, Inc., Document No. 60093, Revision Nov. 24, 2010.

* cited by examiner

*Primary Examiner* — Kyung Lee
(74) *Attorney, Agent, or Firm* — Dority & Manning, P.A.

(57) ABSTRACT

An ultra wideband frequency compensated resistor and related methodologies for frequency compensation are disclosed. In exemplary configuration, a resistive layer is provided over a substrate, and a frequency compensating structure is provided over at least a portion of the resistive layer and separated therefrom by an insulative layer. In certain embodiments, the insulating layer may be an adhesive that may also be effective to secure a protective cover over the resistive material and supporting substrate. In selected embodiments, the frequency compensating structure corresponds to a plurality of conductive layers, one or more of which may be directly electrically connected to terminations for the resistive material while one or more of the conductive layers are not so connected.

30 Claims, 4 Drawing Sheets

HIGH FREQUENCY RESISTOR

PRIORITY CLAIM

This application claims the benefit of previously filed U.S. Provisional Patent Application entitled "HIGH FREQUENCY RESISTOR," assigned U.S. Ser. No. 61/561,334, filed Nov. 18, 2011, and which is incorporated herein by reference for all purposes.

FIELD OF THE SUBJECT MATTER

The presently disclosed subject matter relates generally to electrical resistors and particularly to ultra wide band surface mount resistors employing thin film technology.

BACKGROUND OF THE SUBJECT MATTER

Surface mounting has become the preferred technique for circuit board assembly such that numerous if not nearly all types of electronic components have been or are being redesigned for surface mount (that is, leadless) applications. The rapid incorporation of surface mount devices (SMD) into all types of electronic circuits has created a demand for high frequency resistors.

Resistors serve an essential function on many circuit boards. There are many different performance characteristics of resistors for which improvement may be sought to facilitate desired operation. A prior example of technology that addresses certain resistor aspects is disclosed in U.S. Pat. No. 7,830,241 to Lai et al. that discloses a film resistor wherein electrodes are embedded within the film resistive material. According to Lai et al., it had been recognized that untrimmed edges of thin film resistive layers had negatively impacted resistor high frequency response. By burying the electrodes in the resistive material, high-frequency response was improved per the Lai et al. disclosure.

U.S. Pat. No. 7,042,232 to Jacob is directed to a cable and substrate compensating custom resistor. The resistor is designed for use in a combination with a test lead having inductive characteristics. The resistor includes a thin film layer on one side of a substrate. On the other side of the substrate, resistive material extends from one termination point toward (but does not reach) a second termination point. Capacitance formed between the resistive layers compensates for high frequency effects on the combined circuit so that with the inductive characteristics of the probe lead, a relatively flat response is indicated as achievable.

U.S. Pat. No. 6,819,569 to Broman et al. is directed to an impedance equalization module. A resistive (NiCr) layer is applied to a dielectric coating that is supported by a copper (Cu) layer, all of which is supported on an aluminum oxide substrate. Compensating Cu electrodes are provided at each end of the resistive layer and function as capacitor electrode layers with the Cu layer.

A publication by TT electronics (entitled "High Frequency Chip Resistor Terminators") describes a device that provides a tantalum nitride (TaN) film over a substrate and includes end termination at either end thereof. The device provides an alumina substrate and does not disclose any form of frequency compensation.

The complete disclosures of all the foregoing United States patents and publications are hereby fully incorporated for all purposes into this application by reference thereto.

BRIEF SUMMARY OF THE SUBJECT MATTER

The presently disclosed subject matter recognizes and addresses various issues as previously discussed, and others concerning certain aspects of resistor and related electronics technology. Thus, broadly speaking, a principal object of the presently disclosed technology is to provide an improved resistor. More particularly, the presently disclosed subject matter describes in at least one embodiment thereof a frequency compensated thin film resistor surface mount device (SMD).

The presently disclosed subject matter in at least one embodiment thereof relates to a frequency compensated resistor having a substrate with an elongated resistor element and a pair of contact pads formed at opposed longitudinal ends thereof formed on one surface of the substrate. In certain presently disclosed exemplary embodiments, the resistive layer may be formed of a layer of tantalum nitride (TaN). In particular presently disclosed exemplary embodiments, the substrate may be a glass material. In still further selected embodiments, the pair of contact pads may correspond to copper (Cu) pads.

Further in accordance with presently disclosed subject matter, a conductive frequency compensating structure in some embodiments may be formed over the resistive layer. In selected embodiments, the conductive frequency compensating structure may correspond to an aluminum (Al) layer. In certain embodiments of the presently disclosed subject matter, the conductive frequency compensating structure may be positioned such that the conductive frequency compensating structure does not contact either of the contact pads. In other presently disclosed exemplary embodiments, the conductive frequency compensating structure may contact one of the conductive pads. In some presently disclosed embodiments, the conductive frequency compensating structure may be formed of a generally rectangular layer. In alternative presently disclosed embodiments, the conductive frequency compensating structure may correspond to a circular or oval shaped layer.

In yet still further presently disclosed embodiments, plural conductive layers of varying longitudinal dimensions may be spaced along the longitudinal length of the resistive layer. One or more of such plural layers may in some instances contact the contact pads while one or more of others of the plural layers may not contact either contact pad.

In additional embodiments of the presently disclosed subject matter, a layer of adhesive material may be formed over at least portions of the substrate material and resistive material between the contact pads, and acts to secure a second insulating layer above and encasing the resistive layer and contact pads. In some embodiments, the adhesive layer may extend over the contact pads. In either of such embodiments, the adhesive layer may provide insulative separation of the resistive layer from the conductive frequency compensating structure, thereby forming with the conductive frequency compensating structure one or more compensating capacitors with the resistive material. In particular presently disclosed embodiments, the second insulating layer may correspond to a glass layer. In such fashion, the resistive layer, substrate, and second insulating layer (possibly glass layer) may be considered to form a sandwich structure.

In additional presently disclosed embodiments, termination material may be applied at opposite ends of the sandwich structure such that the termination material contacts the contact pads and allows for surface mount connection of the completed frequency compensated resistor. In selected embodiments, the termination material may correspond to a flexible termination material. In alternative embodiments, on any resistor design, an insulating layer (organic, sputtered oxide, etc.) can be applied and the frequency compensating structure placed on the top thereof. In selected such embodiments, a generally available existing dielectric passivation layer already present may be used for this purpose.

In still further presently disclosed exemplary embodiments, a frequency compensated surface mount resistor may preferably comprise an elongated substrate having upper and lower surfaces, such surfaces bounded by side portions; a resistive layer formed on such upper surface; a pair of contact pads formed at opposed longitudinal ends of such substrate; and a frequency compensating conductive layer formed over such resistive layer.

In various alternatives of the foregoing exemplary embodiment, such substrate may comprise a glass material, such contact pads may comprise copper pads, and/or such frequency compensating conductive layer may comprise an aluminum layer.

In other presently disclosed alternatives thereof, such frequency compensating conductive layer may be positioned above such resistive layer and configured so as to be out of contact with both of such contact pads. In alternatives thereof, such frequency compensating conductive layer may be positioned above such resistive layer and configured so as to contact at least one of such contact pads.

In yet other presently disclosed variations of some embodiments, such resistive layer may comprise tantalum nitrate and/or such frequency compensating conductive layer may comprise one of a generally rectangular layer, a circular layer, and an oval layer.

In other presently disclosed variations, such an exemplary resistor embodiment may further comprise at least one second frequency compensating conductive layer formed over such resistive layer, and in some instances at least one of such frequency compensating conductive layer and such at least one second frequency compensating conductive layer may be coupled to at least one of such contact pads. In other variations thereof, such frequency compensating conductive layer and such at least one second frequency compensating conductive layer may be each coupled respectively to one of such contact pads of such pair of contact pads.

In yet other presently disclosed alternatives, such frequency compensating conductive layer and such at least one second frequency compensating conductive layer may be generally rectangular, and/or such frequency compensating conductive layer and such at least one second frequency compensating conductive layer may have varying longitudinal dimensions.

Some other presently disclosed alternative resistor embodiments may further comprise at least one third frequency compensating conductive layer formed over such resistive layer, and in some of such alternatives at least one of such frequency compensating conductive layer, such at least one second frequency compensating conductive layer, and such at least one third frequency compensating conductive layer may be coupled to at least one of such contact pads of such pair of contact pads. In other variations, at least one of such frequency compensating conductive layer, such at least one second frequency compensating conductive layer, and such at least one third frequency compensating conductive layer may be coupled to at least one of such contact pads of sad pair of contact pads.

In yet other variations, an exemplary resistor embodiment may further comprise an adhesive layer positioned between such resistive layer and such frequency compensating conductive layer.

Others may alternatively further comprise an insulating layer positioned above and encasing such resistive layer and such pair of contact pads, thereby forming a sandwich structure with such substrate, such resistive layer, and such contact pads. In some of the foregoing, such insulating layer may comprise a glass layer. For others, an exemplary resistor embodiment may further comprise termination material applied at opposite ends of such sandwich structure such that such termination material contacts such contact pads, whereby such termination material permits surface mount connection of the resistor. In some such embodiments, such termination material may comprise a flexible termination material. Further, such termination material may comprise a conductive polymer and/or may be plated with nickel and tin.

Yet another presently disclosed exemplary embodiment relates to an ultra wideband frequency compensated thin film technology resistor. Such an exemplary resistor embodiment preferably comprises an elongated supporting substrate having upper and lower surfaces; a resistive layer formed on such upper surface of such elongated supporting substrate; a frequency compensating conductive layer formed over at least a portion of such resistive layer; and an insulative layer positioned between such resistive layer and such frequency compensating conductive layer.

Some of such foregoing resistor embodiments may further comprise a pair of contact pads formed at opposite ends of such elongated supporting substrate. For still further some of such alternatives, such insulative layer may be configured for encasing such resistive layer and such pair of contact pads, thereby forming a sandwich structure with such supporting substrate, such resistive layer, and such contact pads; such resistor may further include termination material applied at opposite ends of such sandwich structure such that such termination material contacts such contact pads; and such frequency compensating conductive layer may comprise a plurality of conductive layers, at least one of which is directly electrically connected to such termination material, whereby such termination material permits surface mount connection of the resistor.

In other alternative variations of presently disclosed resistor embodiments, such insulative layer thereof may comprise an adhesive. Some such alternatives may further comprise a protective cover secured by such adhesive over such resistive layer and such supporting substrate.

It is to be understood by those of ordinary skill in the art from the complete disclosure herewith that the presently disclosed subject matter equally relates to apparatus as well as corresponding and/or related methodology. One presently disclosed exemplary embodiment of methodology relates to a method for providing frequency compensation for resistive components. Such exemplary method preferably may comprise applying an insulating layer over at least a portion of a resistive structure; and applying at least one frequency compensating conductive layer over a portion of the insulating layer.

In some variations of such exemplary methodology, the method may further comprise applying at least one second frequency compensating conductive layer over a portion of the insulating layer. In other present variations, such method may further comprise providing electrical connection terminals for the resistive component; and coupling the at least one frequency compensating conductive layer to at least one of such electrical connection terminals.

In still further present disclosed exemplary variations, present methodology may further comprise adjusting the thickness and material type of the insulating layer and the size of the frequency compensating conductive layer to adjust the frequency compensating capacitance produced between the resistive layer and the at least one second frequency compensating conductive layer. Yet others thereof may further comprise adjusting the thickness and material type of the insulating layer and the size, number, and position of frequency compensating conductive layers with respect to the resistive layer to adjust the frequency compensating capacitance produced between such resistive layer and the frequency compensating conductive layers.

It is to be understood by those of ordinary skill in the art from the complete disclosure herewith that the presently disclosed subject matter also relates to methods for providing frequency compensating for resistor components. In accordance with such methods, frequency compensating structure may be applied to a resistor structure over an insulating layer covering at least a portion of the resistor structure. In some embodiments, the insulating layer may correspond to a passivation layer covering a portion or all of a resistive layer.

Additional objects and advantages of the presently disclosed subject matter are set forth in, or will be apparent to those of ordinary skill in the art from, the detailed description herein. Also, it should be further appreciated by those of ordinary skill in the art that modifications and variations to the specifically illustrated, referenced, and discussed features and steps hereof may be practiced in various embodiments and uses of this subject matter without departing from the spirit and scope thereof, by virtue of present reference thereto. Such variations may include, but are not limited to, substitution of equivalent means and features, materials, or steps for those shown, referenced, or discussed, and the functional, operational, or positional reversal of various parts, features, steps, or the like.

Still further, it is to be understood that different embodiments, as well as different presently preferred embodiments, of the disclosed technology may include various combinations or configurations of presently disclosed features or elements, or their equivalents (including combinations of features or configurations thereof not expressly shown in the figures or stated in the detailed description).

Those of ordinary skill in the art will better appreciate the features and aspects of the presently disclosed subject matter upon review of the remainder of the specification.

BRIEF DESCRIPTION OF THE DRAWINGS

A full and enabling description of the presently disclosed subject matter, including the best mode thereof, directed to one of ordinary skill in the art, is set forth in the specification, which makes reference to the appended figures, in which.

Figure 1:
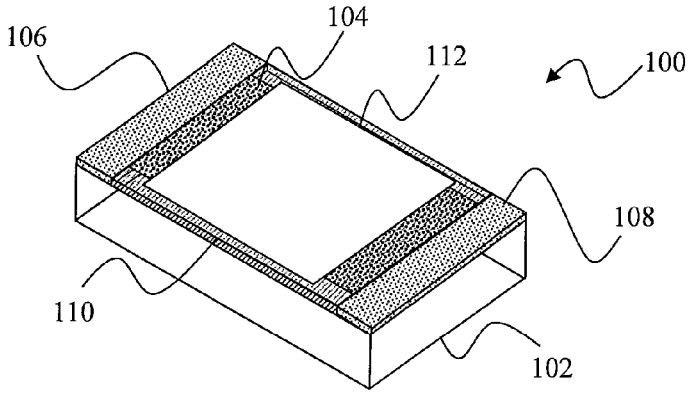
FIG. 1 illustrates a substrate and selected portions of an exemplary ultra wideband resistor mounted thereon in accordance with the presently disclosed subject matter.

Repeat use of reference characters throughout the present specification and appended drawings is intended to represent same or analogous features, steps, or other elements of the presently disclosed technology.

DETAILED DESCRIPTION OF THE PREFERRED EMBODIMENTS

As referenced in the Brief Summary of the Subject Matter section, aspects of the presently disclosed subject matter are directed towards an improved frequency compensated surface mount thin film resistor. Referring to the drawings, FIG. 1 illustrates an exemplary partially completed ultra wideband resistor generally 100 in accordance with presently disclosed technology. Ultra wideband resistor 100 corresponds to a layer of resistive material 104 formed on substrate 102 and extending at least to and in contact with conductive contact pads 106, 108 formed at opposite ends of substrate 102. In accordance with various specific embodiments of the presently disclosed subject matter, substrate 102 may correspond to a glass substrate, resistive material 104 may correspond to a layer of tantalum nitride (TaN), and conductive contact pads 106, 108 may correspond to layers of copper (Cu). Those of ordinary skill in the art will appreciate, however, that other materials may be used for any and all of these specifically named exemplary materials. It should also be appreciated that resistive material 104 may extend all the way to the longitudinal ends of substrate 102 and, in such instance, contact pads 106, 108 will partially cover and make contact with resistive material 104. In other instances, contact pads 106, 108 may be comprised of wire bondable materials such as Aluminum (Al) or gold (Au) or others if the resistor is intended to be used as a wire-bondable device.

A layer of adhesive 110 covers resistive material 104 and portions of the upper surface of substrate 102. Adhesive 110 may, in some embodiments, extend over the upper surface of contact pads 106, 108. In either instance, adhesive layer 110 provides an insulative layer between resistive material 104 and one or more conductive layers corresponding to frequency compensating structure 112. In some embodiments of the presently disclosed subject matter, frequency compensating structure 112 may correspond to one or more layers of aluminum (Al) or other suitable conductive material, as will be more fully described later with respect to FIGS. 7 through 10.

Figure 2:
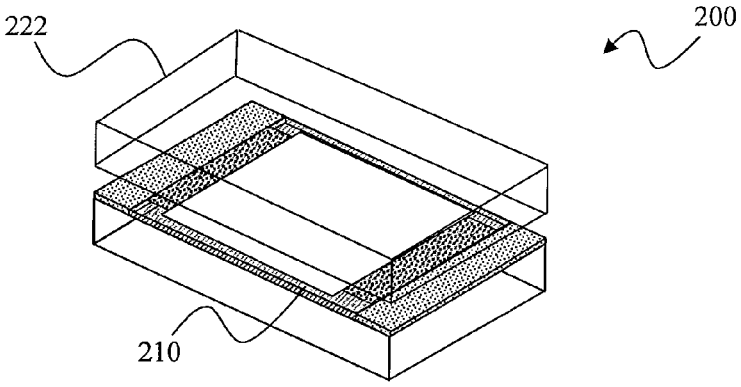
FIG. 2 illustrates in partially exploded form the identical structure illustrated in FIG. 1 but adding an exemplary glass cover for the ultra wideband resistor components.

FIG. 2 illustrates in partially exploded form an ultra wideband resistor generally 200 having identical structure to that illustrated in FIG. 1 but adding a glass cover 222 for the ultra wideband resistor components. In accordance with the presently disclosed subject matter, adhesive layer 210 secures glass cover 222 to the upper surface of the resistor components and thereby provides a protective covering for the components.

Figure 3A:
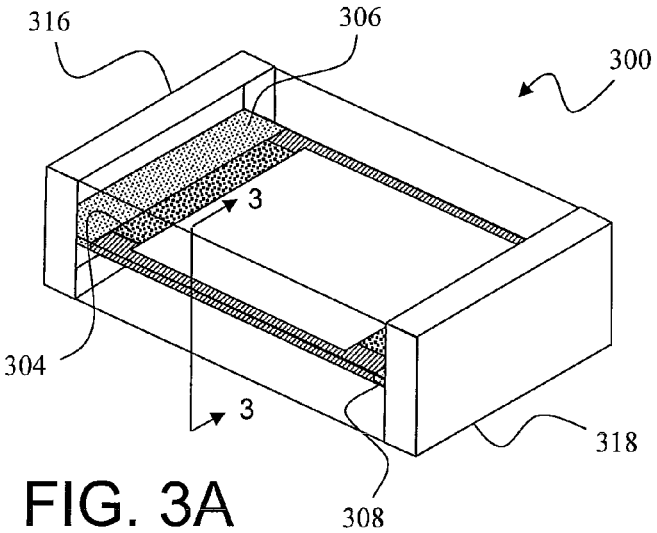
FIG. 3A illustrates an exemplary assembled ultra wideband resistor including terminations in accordance with the presently disclosed subject matter.

FIG. 3A illustrates an assembled ultra wideband resistor generally 300 including terminations in accordance with the presently disclosed subject matter. Terminations 316, 318 couple to the exposed edges of contact pads 306, 308 to provide a conductive pathway to resistive material 304. Terminations 316, 318 may correspond to any generally known configuration but in preferred embodiments the terminations 316, 318 correspond to certain terminations as developed by AVX Corp., the owner of the presently disclosed subject matter. Examples of such include a flexible termination comprising a conductive polymer that ensures electrical integrity is maintained during and after external forces are applied to the component. In an exemplary configuration, such exemplary termination material is achieved by coating a copper (Cu) termination with conductive polymer, which is then plated with Nickel (Ni) and Tin (Sn).

Figure 3B:
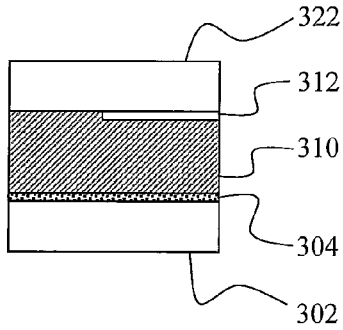
FIG. 3B illustrates a cross section of the ultra wideband resistor of FIG. 3A looking in the direction of section line 3-3 of FIG. 3A.

FIG. 3B illustrates a cross section of the ultra wideband resistor generally 300 looking in the direction of section line 3-3 of FIG. 3A. As illustrated, ultra wideband resistor 300 is constructed in layers including a substrate 302, resistive material 304, adhesive 310, frequency compensating structure 312, and glass cover 322. As represented in FIG. 3B, adhesive layer 310 may be relatively thick. The thickness as well as other insulative properties of the adhesive contributes toward determining the compensating capacitance produced between the frequency compensating structure 312 and resistive material 304.

Figure 4:
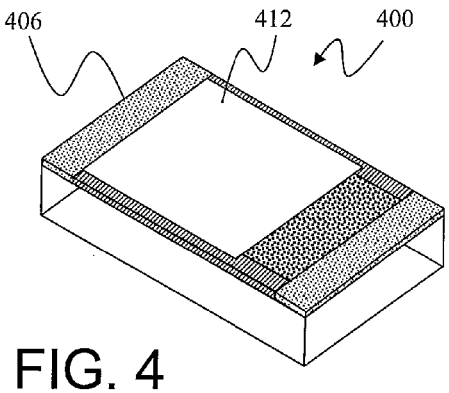
FIG. 4 illustrates a portion of an alternative presently disclosed exemplary embodiment of an ultra wideband resistor, corresponding generally to the portion of an ultra wideband resistor as illustrated in FIG. 1.

FIG. 4 illustrates a portion of an alternative embodiment of an ultra wideband resistor generally 400 corresponding to the resistor portion illustrated in FIG. 1, but which is without the top glass covering. As illustrated in FIG. 4, frequency compensating structure 412 may be positioned to be in electrical contact with contact pad 406.

Figure 5:
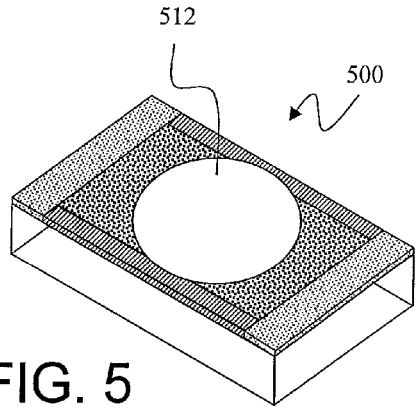
FIG. 5 illustrates a portion of another alternative presently disclosed exemplary embodiment of the ultra wideband resistor corresponding generally to the portion illustrated in FIG. 1.

FIG. 5 illustrates a portion of another alternative embodiment of an ultra wideband resistor generally 500, again corresponding to the resistor portion illustrated in FIG. 1. In such embodiment of the presently disclosed subject matter, frequency compensating structure 512 may correspond to a circular conductive layer. As in previous embodiments, the conductive layer may be formed of aluminum (Al) or any other suitable conductive material. It should be generally understood from the illustrations in FIGS. 4 and 5 that the frequency compensating structure may take on various geometric forms. As such, the frequency compensating structure is not limited to the rectangular or circular forms presently illustrated but rather may correspond to any suitable form that provides the necessary coverage area to produce the frequency compensation required.

Figure 6:
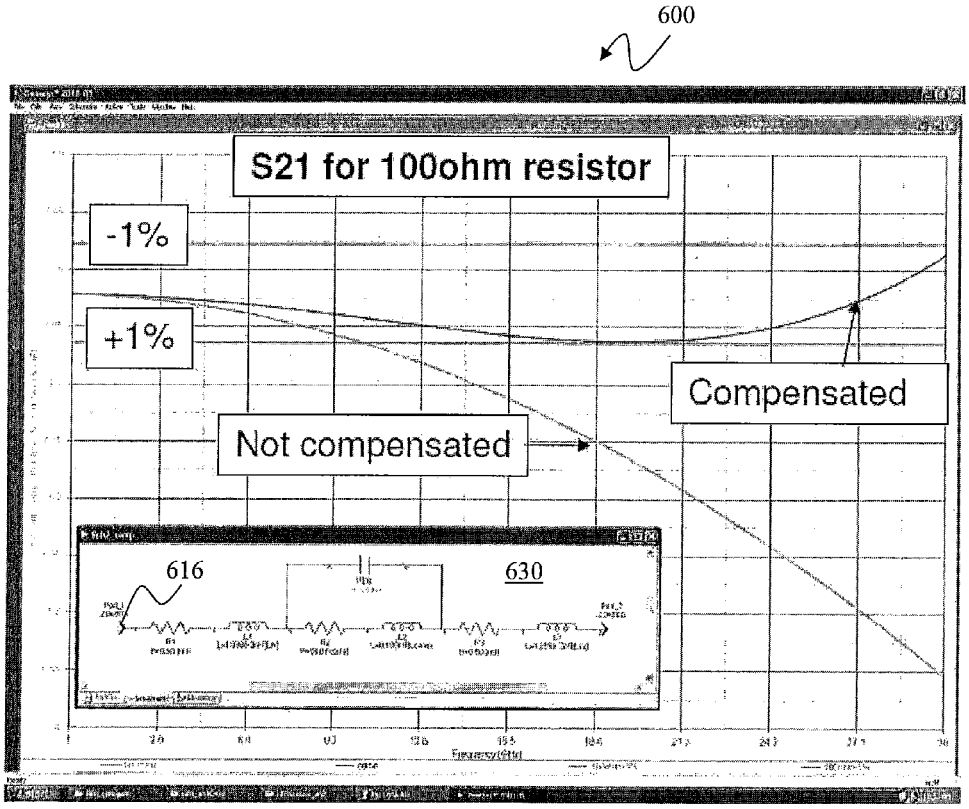
FIG. 6 illustrates a graph showing compensation results obtain from an exemplary resistor constructed in accordance with the presently disclosed subject matter.

FIG. 6 illustrates a graph 600 showing exemplary compensation results obtained from an exemplary resistor constructed in accordance with the presently disclosed subject matter. As will be understood by those of ordinary skill from graph 600, results are illustrated for testing an exemplary 10052 resistor constructed in accordance with the presently disclosed subject matter and for testing a similar resistor that has not been compensated in accordance with the presently disclosed subject matter. As illustrated, a resistor that has not been compensated quickly falls out of a preferred ±1% range as the applied frequency increases from about 1 GHz to about 30 GHz. On the other hand, by use of the presently disclosed compensation methodologies, the compensated resistive value remains with the ±1% range over such exemplary frequency range.

In order to better appreciate how frequency compensation in accordance with the presently disclosed subject matter is achieved, an equivalent circuit 630 is represented per an inset box as illustrated within graph 600. As illustrated in equivalent circuit 630, an exemplary compensated resistor may be represented as several resistor and inductor components coupled in series with capacitive components bridging portions of the equivalent series circuit. As illustrated in equivalent circuit 630, a single capacitor bridges a central resistor/inductor combination. Such equivalent circuit would be most particularly representative of an appropriate equivalent circuit for the resistor illustrated in FIG. 3 where the frequency compensating structure is not in direct electrical contact with either end termination 316 or 318.

In alternative embodiments such as illustrated in FIG. 4, the single equivalent capacitor of equivalent circuit 630 may, for example, be connected at one terminal thereof to the left most terminal 616.

Figure 7:
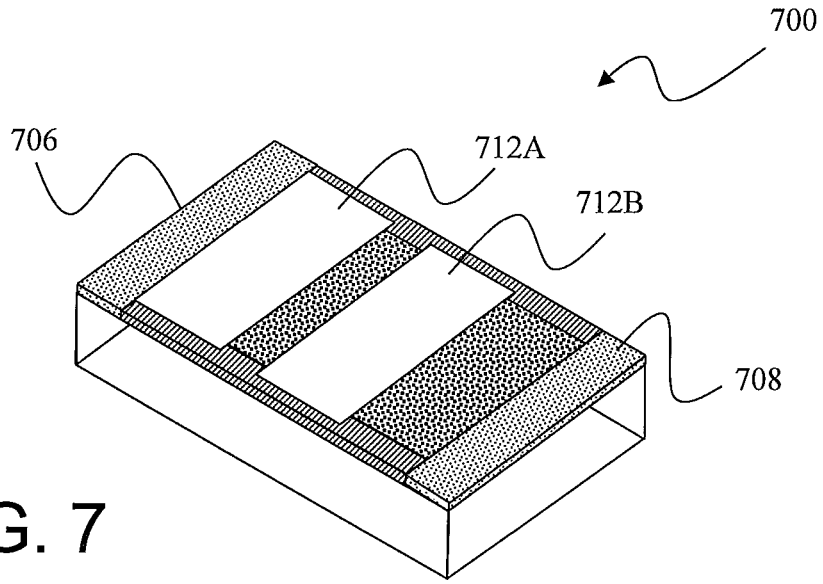
FIGS. 7 through 10 illustrate, respectively, alternative presently disclosed exemplary configurations of the frequency compensation structure employing a plurality of conductive layers variously coupled or not to the contact pads of the ultra wideband resistor.
Figure 8:
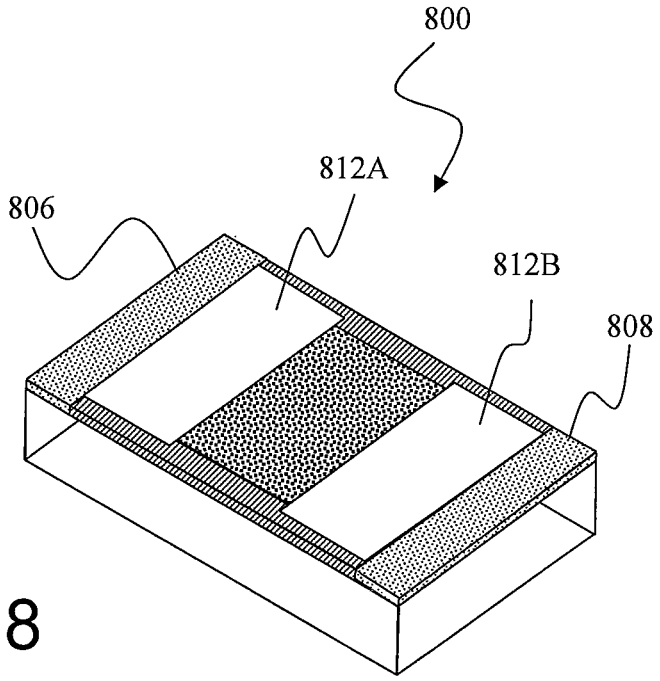

Referring to FIGS. 7 through 10, there are illustrated further alternative exemplary configurations of a frequency compensation structure employing a plurality of conductive layers variously coupled or not to the contact pads of the ultra wideband resistor, all in accordance with presently disclosed technology. FIG. 7 illustrates a resistor generally 700 where the frequency compensation structure corresponds to two separate conductive layers 712A, 712B. It will be noted that conductive layer 712A is in electrical contact with contact pad 706 while conductive layer 712B is not directly connected to either contact pad 706 or 708. In such exemplary arrangement, an equivalent circuit would correspond to one with a pair of capacitors bridging different resistor/inductor sections of the equivalent circuit where one of the capacitors would representatively be coupled to a terminal such as terminal 616 of FIG. 6.

Figure 9:
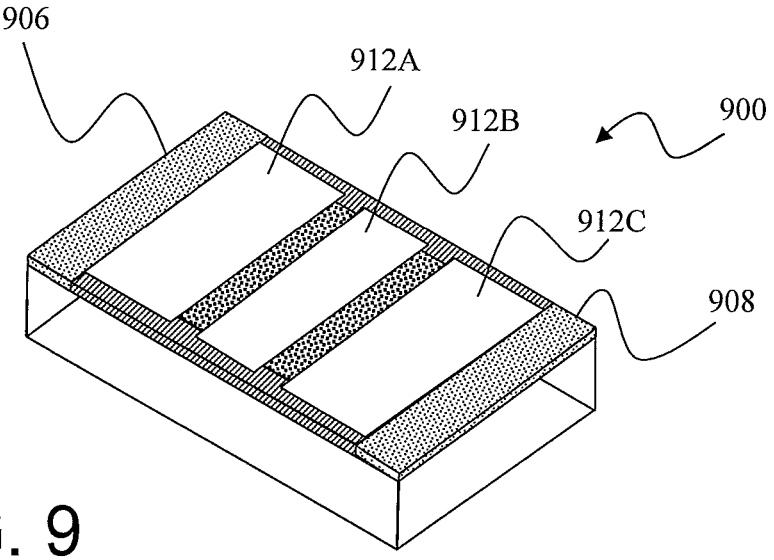
Figure 10:
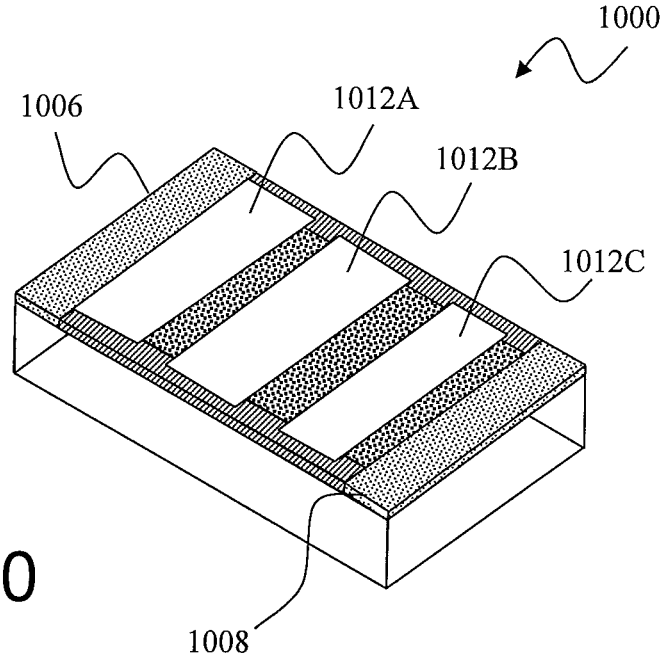

With such explanation, it should be clear to those of ordinary skill in the art that the other exemplary embodiments of resistors generally 800, 900, and 1000, illustrated respectively in FIGS. 9 through 11, operate in similar manner and offer additional options for frequency compensation. For example, resistor generally 800 of FIG. 8 may provide two conductive layers 812A, 812B each coupled electrically to a respective termination 806, 808. Similarly, resistor generally 900 of FIG. 9 provides three conductive layers 912A, 912B, 912C where two conductive layers 912A, 912C are directly electrically coupled to respective contact pads 906, 908. Similarly, as illustrated in FIG. 10, three conductive layers 1012A, 1012B, 1012C are provided but only one layer (layer 1012A) is directly electrically connected to contact pad 1006.

While the presently disclosed subject matter has been described in detail with respect to specific embodiments thereof, it will be appreciated that those skilled in the art, upon attaining an understanding of the foregoing, may readily produce alterations to, variations of, and/or equivalents to such embodiments. Accordingly, the scope of the present disclosure is by way of example rather than by way of limitation, and the subject disclosure does not preclude inclusion of such modifications, variations and/or additions to the presently disclosed subject matter as would be readily apparent to one of ordinary skill in the art.

What is claimed is:

1. A frequency compensated surface mount resistor, comprising:

an elongated substrate having upper and lower surfaces, said surfaces bounded by side portions;

a resistive layer formed on said upper surface;

a pair of contact pads formed at opposed longitudinal ends of said substrate; and a frequency compensating conductive layer formed over said resistive layer.

2. A resistor as in claim 1, wherein said substrate comprises a glass material.

3. A resistor as in claim 1, wherein said contact pads comprise one of copper pads and pads comprising wire bondable material.

4. A resistor as in claim 1, wherein said frequency compensating conductive layer comprises an aluminum layer.

5. A resistor as in claim 1, wherein said frequency compensating conductive layer is positioned above said resistive layer and configured so as to be out of contact with both of said contact pads.

6. A resistor as in claim 1, wherein said frequency compensating conductive layer is positioned above said resistive layer and configured so as to contact at least one of said contact pads.

7. A resistor as in claim 1, wherein said resistive layer comprises tantalum nitrate.

8. A resistor as in claim 1, wherein said frequency compensating conductive layer comprises one of a generally rectangular layer, a circular layer, and an oval layer.

9. A resistor as in claim 1, further comprising at least one second frequency compensating conductive layer formed over said resistive layer.

10. A frequency compensated surface mount resistor, comprising:

an elongated substrate having upper and lower surfaces, said surfaces bounded by side portions;

a resistive layer formed on said upper surface;

a pair of contact pads formed at opposed longitudinal ends of said substrate;

a frequency compensating conductive layer formed over said resistive layer; and at least one second frequency compensating conductive layer formed over said resistive layer;

wherein at least one of said frequency compensating conductive layer and said at least one second frequency compensating conductive layer is coupled to at least one of said contact pads.

11. A resistor as in claim 9, wherein said frequency compensating conductive layer and said at least one second frequency compensating conductive layer are each coupled respectively to one of said contact pads of said pair of contact pads.

12. A resistor as in claim 9, wherein said frequency compensating conductive layer and said at least one second frequency compensating conductive layer are generally rectangular.

13. A resistor as in claim 12, wherein said frequency compensating conductive layer and said at least one second frequency compensating conductive layer have varying longitudinal dimensions.

14. A resistor as in claim 10, further comprising at least one third frequency compensating conductive layer formed over said resistive layer.

15. A resistor as in claim 14, wherein at least one of said frequency compensating conductive layer, said at least one second frequency compensating conductive layer, and said at least one third frequency compensating conductive layer is coupled to at least one of said contact pads of said pair of contact pads.

16. A resistor as in claim 14, wherein at least one of said frequency compensating conductive layer, said at least one second frequency compensating conductive layer, and said at least one third frequency compensating conductive layer is coupled to at least one of said contact pads of sad pair of contact pads.

17. A resistor as in claim 1, further comprising an adhesive layer positioned between said resistive layer and said frequency compensating conductive layer.

18. A resistor as in claim 1, further comprising an insulating layer positioned above and encasing said resistive layer and said pair of contact pads, thereby forming a sandwich structure with said substrate, said resistive layer, and said contact pads.

19. A resistor as in claim 18, wherein said insulating layer comprises a glass layer.

20. A resistor as in claim 18, further comprising:

termination material applied at opposite ends of said sandwich structure such that said termination material contacts said contact pads, whereby said termination material permits surface mount connection of the resistor.

21. A resistor as in claim 20, wherein said termination material comprises a flexible termination material.

22. A resistor as in claim 21, wherein said termination material comprises a conductive polymer.

23. A resistor as in claim 20, wherein said termination material is plated with nickel and tin.

24. A method for providing frequency compensation for resistive components, comprising:

applying an insulating layer over at least a portion of a resistive structure;

applying at least one frequency compensating conductive layer over a portion of the insulating layer; and adjusting the thickness and material type of the insulating layer and the size of the frequency compensating conductive layer to adjust the frequency compensating capacitance produced between the resistive layer and the at least one frequency compensating conductive layer.

25. An ultra wideband frequency compensated thin film technology resistor, comprising:

an elongated supporting substrate having upper and lower surfaces;

a resistive layer formed on said upper surface of said elongated supporting substrate;

a frequency compensating conductive layer formed over at least a portion of said resistive layer; and an insulative layer positioned between said resistive layer and said frequency compensating conductive layer.

26. A resistor as in claim 25, further comprising a pair of contact pads formed at opposite ends of said elongated supporting substrate.

27. A resistor as in claim 25, wherein said insulative layer comprises an adhesive.

28. A resistor as in claim 27, further comprising a protective cover secured by said adhesive over said resistive layer and said supporting substrate.

29. An ultra wideband frequency compensated thin film technology resistor, comprising:

an elongated supporting substrate having upper and lower surfaces;

a resistive layer formed on said upper surface of said elongated supporting substrate;

a frequency compensating conductive layer formed over at least a portion of said resistive layer;

an insulative layer positioned between said resistive layer and said frequency compensating conductive layer; and a pair of contact pads formed at opposite ends of said elongated supporting substrate; wherein said insulative layer is configured for encasing said resistive layer and said pair of contact pads, thereby forming a sandwich structure with said supporting substrate, said resistive layer, and said contact pads;

said resistor further includes termination material applied at opposite ends of said sandwich structure such that said termination material contacts said contact pads; and wherein said frequency compensating conductive layer comprises a plurality of conductive layers, at least one of which is directly electrically connected to said termination material, whereby said termination material permits surface mount connection of the resistor.

30. A resistor as in claim 26, wherein said contact pads comprise one of copper pads and pads comprising wire bondable material.

* * * * *